US005560187A

United States Patent [19]

Nagashima et al.

[11] Patent Number: 5,560,187

[45] Date of Patent: Oct. 1, 1996

[54] STRAPPING MACHINE

[75] Inventors: Akira Nagashima, Yokohama; Tadashige Kondo; Keisuke Ishii, Tokyo, all of Japan

[73] Assignee: Kioritz Corporation, Tokyo, Japan

[21] Appl. No.: 362,000

[22] Filed: Dec. 22, 1994

[30] Foreign Application Priority Data

Dec. 28, 1993 [JP] Japan ..... 5-335528

[51] Int. Cl.[6] ..... B65B 13/04

[52] U.S. Cl. ..... 53/589; 53/582; 100/26

[58] Field of Search ..... 53/582, 588, 589; 100/25, 26

[56] References Cited

U.S. PATENT DOCUMENTS 5,079,899 1/1992 Kurachi .

FOREIGN PATENT DOCUMENTS 2906425 9/1979 Germany .

3610631 10/1987 Germany .

61-21304 1/1986 Japan .

4-13205 3/1992 Japan .

*Primary Examiner*—Linda Johnson

*Attorney, Agent, or Firm*—Armstrong, Westerman, Hattori, McLeland & Naughton

[57] ABSTRACT

A strapping machine is disclosed which is adapted to be capable of constantly attaining a stable secondary tightening force and thereby capable of preventing a band from coming off the object under strapping, which enables a reduced power consumption cost to be realized, and which can be constructed simply and inexpensively as a whole. The strapping machine comprises a feed/backfeed stepping motor M2 as a source of driving force for a mechanism F including a feed/backfeed roller 8 for conducting feed and backfeed of a band B to be looped around a periphery of an object to be strapped and the like operation; the strapping machine being provided with a reverse rotation preventive means 87, S for timely locking rotation of the feed/backfeed roller 8 in the feed direction $D_F$ of the band B while always permitting rotation of the feed/backfeed roller 8 in the backfeed direction $D_B$ of the band B.

6 Claims, 9 Drawing Sheets

STRAPPING MACHINE

BACKGROUND OF THE INVENTION

1. Field of the Invention

The present invention relates to a strapping machine, in particular, it relates to a strapping machine adapted to be capable of automatically or semi-automatically conducting a procedure-which includes looping a band made of a tape of a thermoplastic resin such as a polypropylene around an object to be strapped, and fusion-bonding overlapping end portions of the band to effect strapping.

2. Description of the Prior Art

To realize heightened efficiency and energy saving in strapping operation, a strapping machine has already been practically used in general which is adapted to be capable of automatically or semi-automatically conducting a procedure that includes looping a band made of a thermoplastic resin tape around an object to be strapped, tightening the band, fusion-bonding the resulting nodally overlapping end portions of the band under heat and pressure, and cutting the band. In other words, as already well-known, a strapping machine of this type is adapted to conduct a strapping procedure that includes holding, pressing, fusing and cutting a band and the like operation by rotationally driving a cam shaft and various cams fixedly fitted on the cam shaft by driving force from an electric motor to effect staggered actuations of mechanisms such as a press, heater plate and a slide table.

In such a conventional strapping machine, two-stage tightening is generally conducted as an operation for tightening a band, which comprises primary tightening for high-speed/low-torque low-torque tightening of a band and secondary tightening under low-speed/high-torque operation (see, for example, Japanese Examined Patent Publication No. 13205/1992). The transition from the primary tightening to the secondary tightening is effected by changeover of operation mode by means of a switch capable of sensing tension or the like means (see, for example, Japanese Unexamined Patent Publication No. 21304/1986).

Further, the applicant of the present invention has proposed a strapping machine which comprises stepping motors capable of rapidly and precisely controlling a rotational speed and a displacement angle according to number of pulses as a band feeding/tightening(feed/backfeed) motor and a cam driving motor, a resonance preventive damper mounted on an output shaft of the feed/backfeed motor, and a step-out sensor located between the damper and a motor body and utilizing a hall element and magnets to count number of pulses in a CPU (Japanese Patent Application No. 226189/1993). According to this proposal, number of motor driving pulses within an interval between pulses generated by passage of magnets over the hall element-located position is counted by means of the CPU. When the number exceeds a predetermined value (i.e.,tension in excess of predetermined one is exerted on a band), step-out is regarded as having taken place, thereby enabling changeover from primary tightening to secondary tightening to be effected automatically and smoothly. Further, vibration is damped and generation of noise is diminished.

In such a conventional strapping machine, however, there is a disadvantage that although fusion-bonding of a band is conducted with the band clamped by a rear clamp upon completion of the secondary tightening, the band tightened on purpose is likely to loosen and come off an object to be strapped during the period from the completion of the secondary tightening to a time point when the rear clamp becomes effectively in action. Accordingly, to prevent reverse rotation of the feed/backfeed motor in the feed direction, voltage application to the motor is required to be continued to hold the motor in a stopped state. This results in a problem of substantial power consumption for holding the motor in a stopped state, which is a disadvantage in terms of cost.

SUMMARY OF THE INVENTION

The present invention has been made in view of these problems. It is, in particular, an object of the present invention to provide a strapping machine which is adapted to be capable of constantly attaining a stable secondary tightening force in conformity with properties of an object to be strapped and thereby capable of preventing a band from coming off the object under strapping, which enables a reduced power consumption cost to be realized, and which can be constructed simply and inexpensively as a whole.

To attain the above-mentioned object, the strapping machine according to the present invention, as a basic embodiment, comprises a feed/backfeed stepping motor as a source of driving force for a mechanism including a feed/backfeed roller for conducting feed and backfeed of a band to be looped around a periphery of an object to be strapped and the like operation; the strapping machine being provided with a reverse rotation preventive means for timely locking rotation of the feed/backfeed roller in the feed direction of the band while always permitting rotation of the feed/backfeed roller in the backfeed direction of the band.

As preferred embodiments, there may be mentioned one wherein the reverse rotation preventive means includes a one-way clutch; one wherein the reverse rotation preventive means further includes a brake band wound around the output shaft of the feed/backfeed stepping motor, and a driving solenoid for tightening up said brake band so as to brake the rotation of the output shaft in the feed direction; one wherein a resonance preventive damper is detachably mounted on the tip of the output shaft at the side opposite to the output side; and one wherein a step-out sensor including a hall element and magnets is provided between a motor body of the feed/backfeed stepping motor and the tip of the output shaft.

In the strapping machine according to the present invention which is constructed as described above, when the tension exerted upon the band B by the secondary tightening reaches a preset upper limit, the resulting high torque is exerted on the feed/backfeed stepping motor. Consequently, the feed/backfeed stepping motor is automatically stopped due to the step-out. During the period of the secondary tightening, the rotation of the feed/backfeed roller in the feed direction is mechanically prevented by the action of the reverse rotation preventive means, thereby reliably preventing a band from loosening and coming off an object under strapping.

DESCRIPTION OF THE PREFERRED EMBODIMENT

Now, an embodiment of the present invention will be described with reference to the accompanying drawings.

Figure 1:
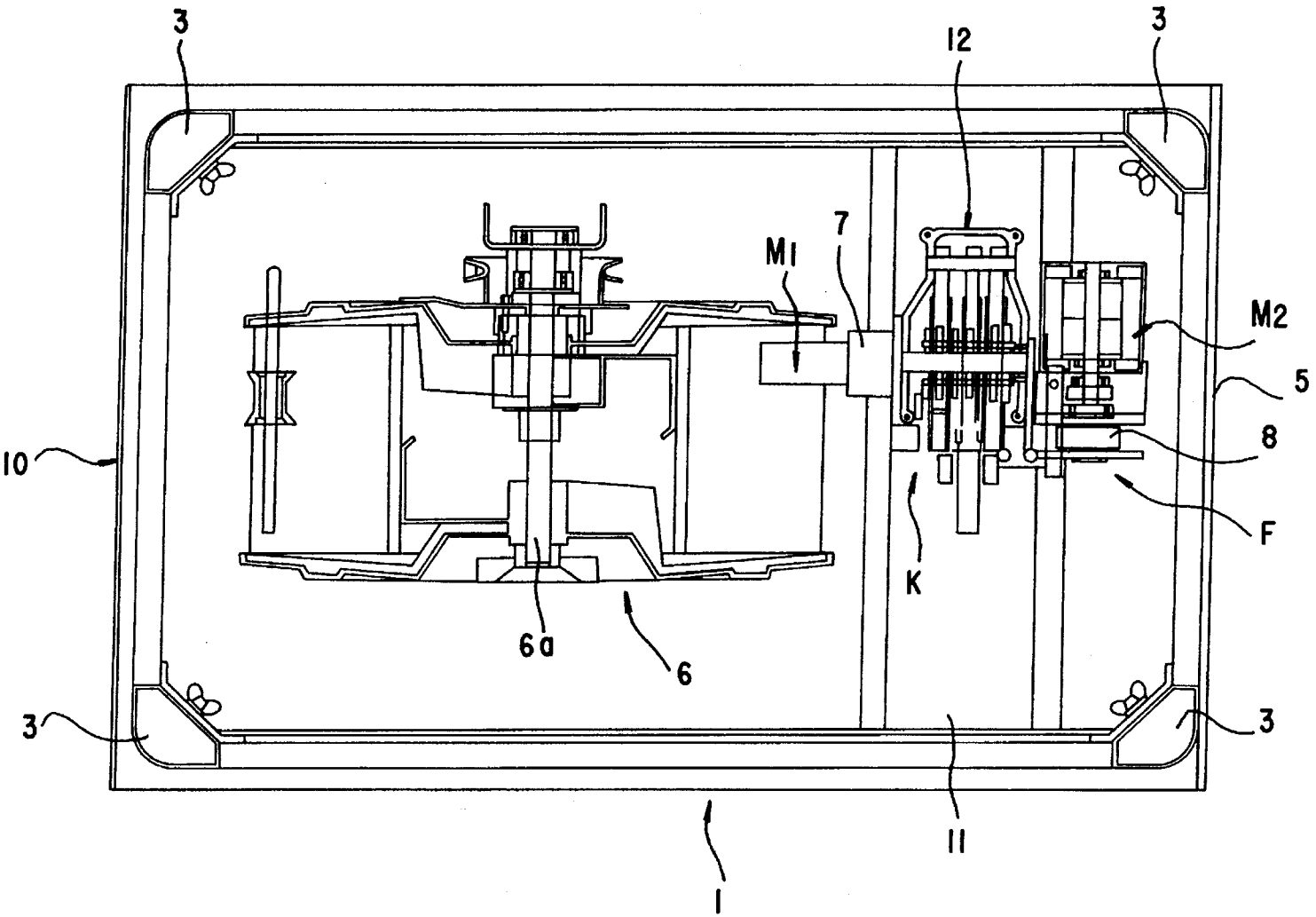
FIG. 1 is a schematic plan view of one embodiment of the strapping machine according to the present invention, which is illustrated with its top plate removed by way of generally showing interior thereof.
Figure 2:
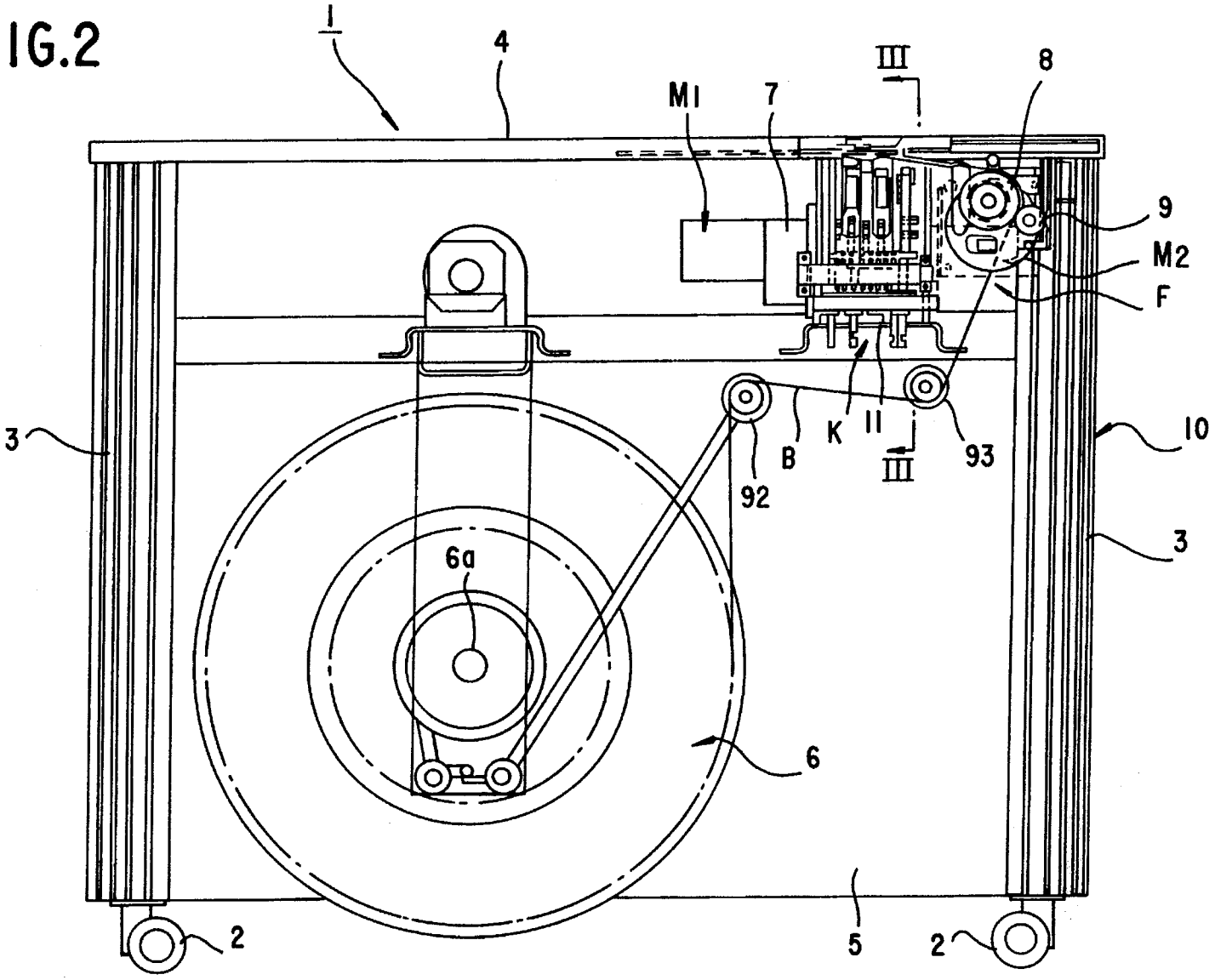
FIG. 2 is a schematic front view of the strapping machine shown in FIG. 1.
Figure 3:
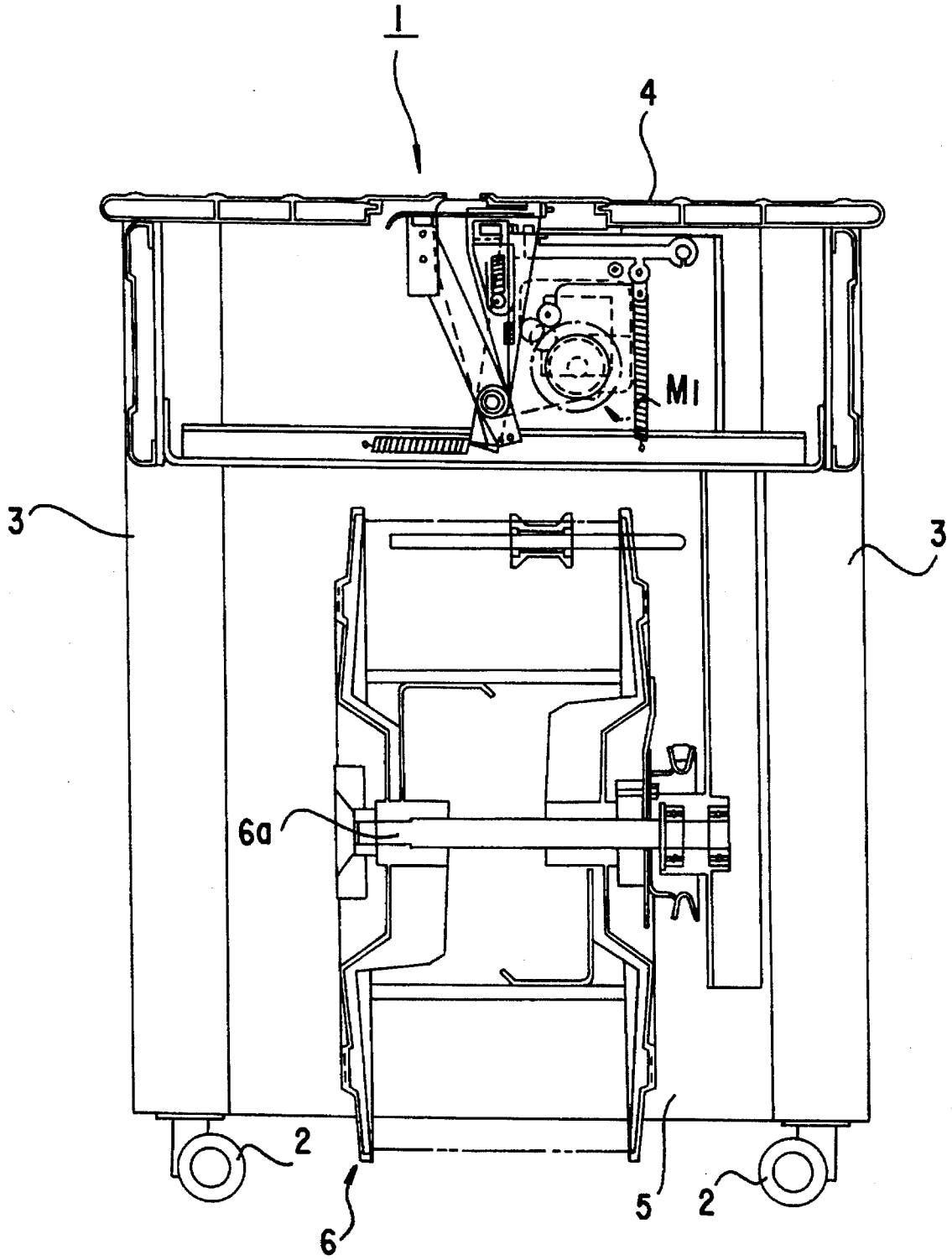
FIG. 3 is a schematic sectional side view taken along the line III—III and viewed in the direction of the arrow in FIG. 2.

FIG. 1 is a schematic plan view of one embodiment of the strapping machine according to the present invention, which is illustrated with its top plate removed by way of generally showing interior thereof. FIG. 2 is a schematic front view of the same. FIG. 3 is a schematic sectional side view of the same taken along the line III—III and viewed in the direction of the arrow in FIG. 2.

In FIGS. 1 to 3, the strapping machine 1 according to the illustrated embodiment comprises a box-like strapping machine body 10 as a frame member which includes posts 3, 3, . . . having their lower ends provided with casters 2, 2, . . . , a top plate 4 horizontally mounted on and spanning the upper ends of the posts 3, 3, . . . , side plates 5 surrounding four sides of the frame member, monitoring windows (not shown) openably formed at appropriate positions in the side plate 5 and the like. On the top of the strapping machine body 10, a band guiding arch (not shown) which is tubular and formed into a staple-like shape for automatically putting a band B around an object to be strapped may further be mounted, if desired. The posts 3, 3 . . . , and the top plate 4 are, for example, integrally formed by extrusion molding of aluminum.

In the strapping machine body 10, a band reel 6 is disposed with its shaft 6a transversely set which is capable of being loaded with a band coil. In the strapping machine body 10, in a portion opposite to the portion where the band reel 6 is located (right portion in FIGS. 1 and 2) and at an upper level is beam-wise fixedly mounted a supporting plate 11 which extends horizontally and transversely, and on the upper surface of the supporting plate 11 is fixedly mounted a frame 12 having a horizontal cross-section of a staple-like shape. Between right and left side plates 12*b* and 12*a* of the frame 12 is disposed a means K for nodal end treatment of fed-in band (detailed description is given hereinbelow) which includes various cams and arms for holding, pressing, fusing, and cutting of the band B. On the outer surface of the left side plate 12*a* of the frame 12 is mounted a cam driving stepping motor M1 provided with a speed reducer 7 for driving the means K for the nodal end treatment in alignment with the means K. Outside the right side plate 12*b* is fixed in juxtaposition therewith a band feeding/tightening (hereinafter also referred to as "feed/backfeed") means F including a reversely rotatable feed/backfeed stepping motor M2, a feed/backfeed roller 8, a rocker roller 9 and the like.

Then, the strapping machine 1 according to the illustrated embodiment will be described in detail.

Figure 4:
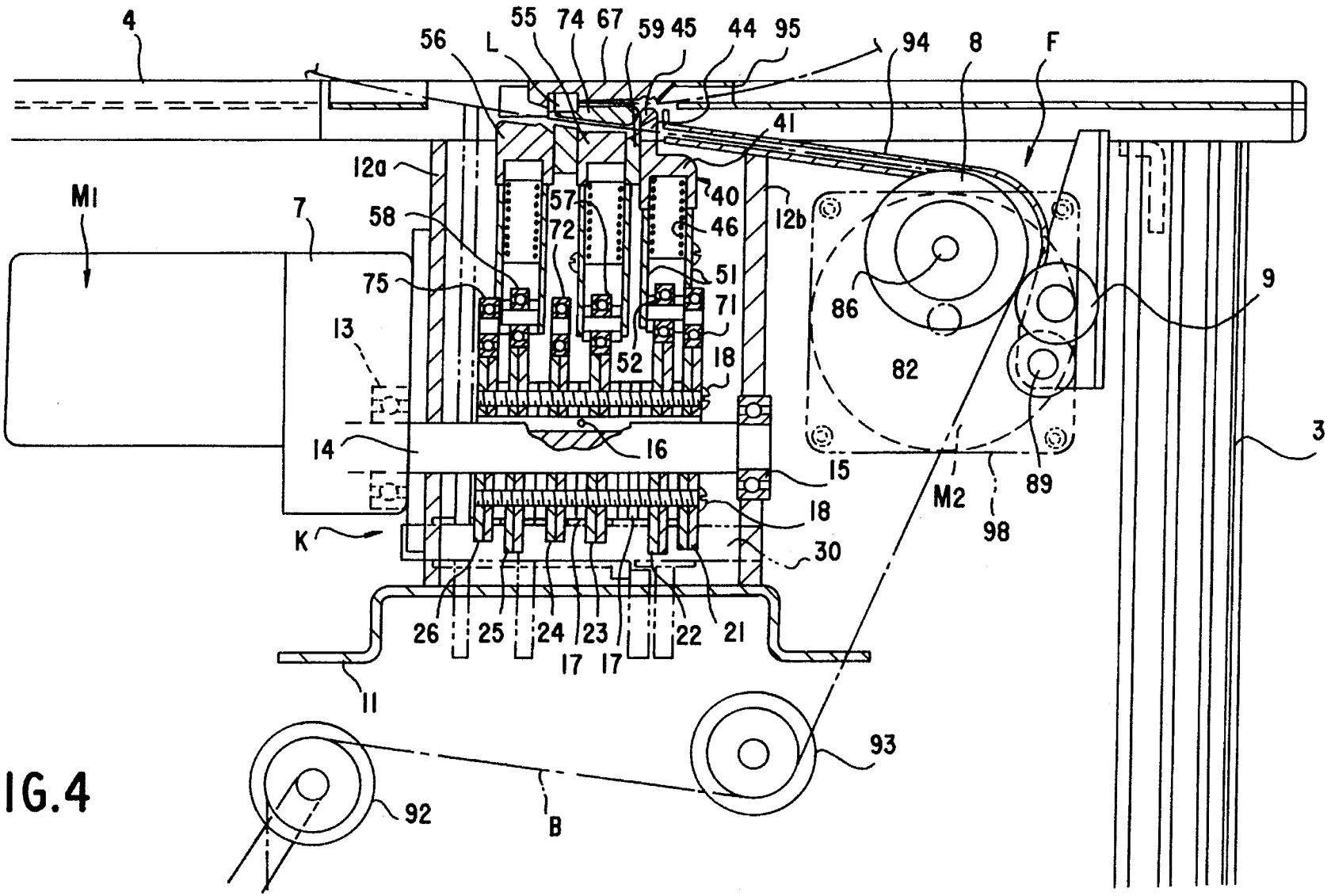
FIG. 4 is an enlarged view of the operative portion in FIG. 2.
Figure 5:
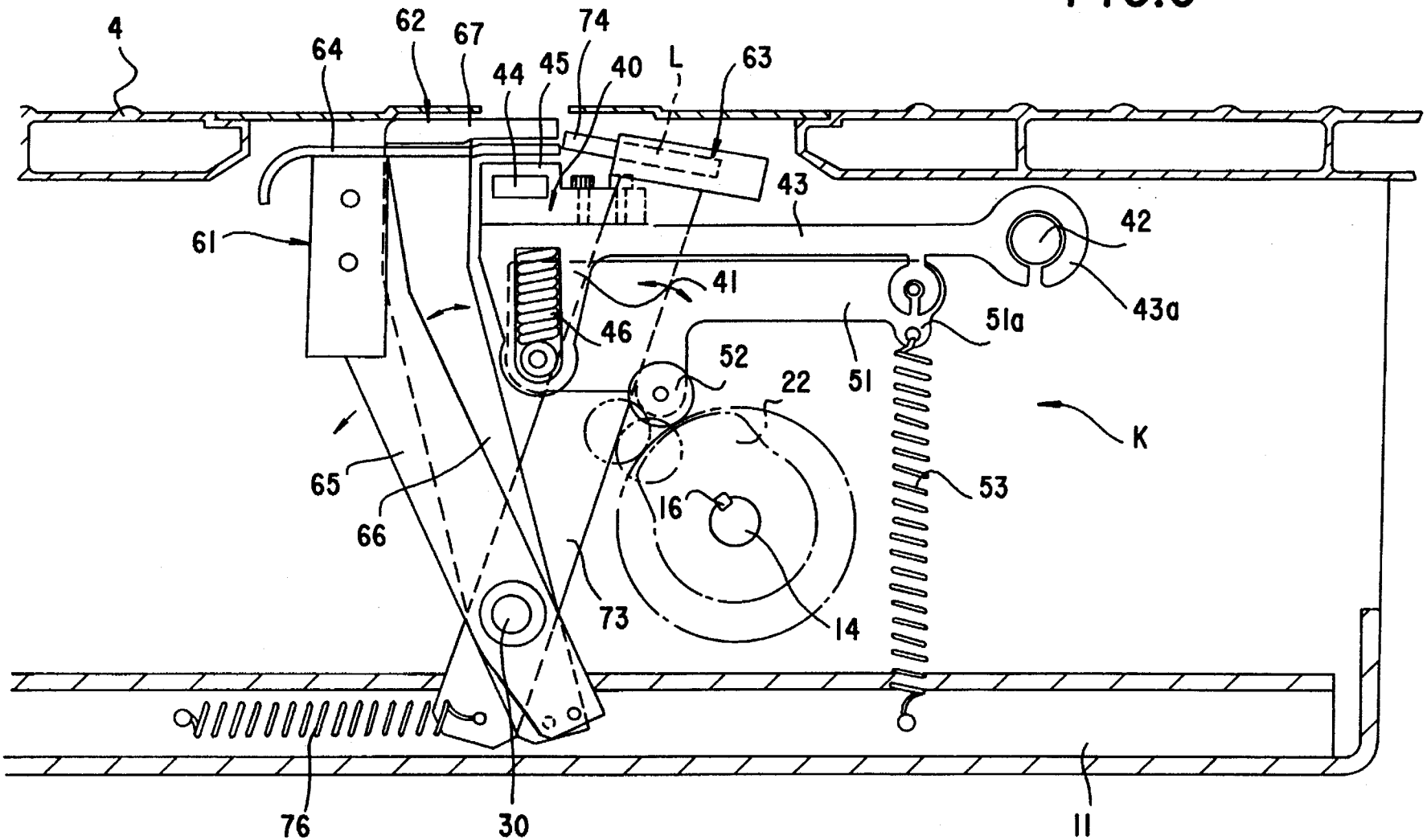
FIG. 5 is an enlarged view of the operative portion in FIG. 3.

FIG. 4 is an enlarged view of the operative portion in FIG. 2, and FIG. 5 is an enlarged view of the operative portion in FIG. 3.

First, explanation is given with respect to the means K for the nodal end treatment.

Driving force from the cam driving stepping motor M1 is decelerated by means of the speed reducer 7 and transmitted to a cam shaft 14 journaled on a rolling bearing 13. The cam shaft 14 is transversely mounted between the side plates 12*a* and 12*b* of the frame 12, and on the part of the right side plate 12*b*, it is journaled on a rolling bearing 15.

As shown in FIG. 4, a heater cam 21, a front clamp cam 22, a press cam 23, a slide cam 24, a rear clamp cam 25, and an inner slide cam 26 are fitted on the cam shaft 14, and locked by a key 16. Each of the cams 21–26 is formed by laminating two planar pieces duplicate each other which have been punched out in a predetermined shape by means of a punching press. To form an appropriate spacing between each neighboring cams, planar spacers 17, 17, . . . , which are of the same circular shape and made of a plastic or the like, are interposed between the cams and fitted on the cam shaft 14 co-axially with the cams 21–26, and the spacers 17, 17, . . . and the cams 21–26 are securely screwed together by means of bolts 18, 18.

Between the right and left side plates 12*b* and 12*a*, a front clamp 40 is disposed which vertically moves in response to rotation of the front clamp cam 22. The front clamp 40 comprises a spring inserting portion 41 having a gate-shaped cross-section, an elongate flat arm 43 formed integrally with the spring inserting portion 41 and having its root end formed with a partially cut away ring portion 43*a* pivotally mounted on a pivot 42, and a head 45 fixed onto the spring inserting portion 41 by bolts or the like. The front clamp 40 is formed by extrusion molding of material such as aluminum, and a guide aperture 44 for guiding a band during feeding is formed in the head 45 by perforation.

To the inner surfaces of right and left legs (when viewed in section) of the spring inserting portion 41, cam roller supporting members 51, 51 made of a steel are attached which extend transversely (in the right direction in FIG. 5) from the spring inserting portion 41 in parallel with the arm 43. In an upper portion of the space defined by the cam roller supporting members 51, 51, a spring member 46 which exhibits buffer action is inserted. In a lower portion thereof, a cam roller 52 which swings in response to the motion of the front clamp cam 22 is held between the cam roller supporting members 51,51. The cam roller supporting member 51 is pivotally mounted on the arm 43 of the front clamp 40 at its root end 51*a*, and a spring member 53 is interposed between the root end 51*a* and the supporting plate 11 for biasing to cause the cam roller 52 to be pressed against the clamp cam 22.

Likewise, the press 55 and the rear clamp 56 have substantially the same structures as that of the front clamp 40 (detailed explanation on the structures is accordingly omitted), and are provided with cam rollers 57, 58 which swing in response to the motions of the press cam 23 and the rear clamp cam 25, respectively. In this connection, a cutter member 59 for cutting a band is unitedly fixed onto an upper side edge of the press 55.

As shown in FIG. 5, a heater member 61, a slide member 62 and a middle slide member 63 are swingably arranged in the vicinity of the upper end of the space between the side plates 12*a* and 12*b*. The heater member 61 comprises a heater plate 64 located on its upper end, and a heater arm 65 fixed to the lower surface of the heater plate 64 and extending downward. The heater arm 65 is swingably journaled on a pivot 30 transversely mounted between the side plate 12*a* and 12*b*. The heater arm 65 is adapted to be swingable in association with the heater cam 21 via a cam roller 71.

Likewise, the slide member 62 comprises a slide arm 66 journaled on the pivot 30, and a slide table 67 fixed to the upper surface of the slide arm 66. The slide arm 66 is adapted to be swingable in association with the slide cam 24 via a cam roller 72.

Further, on the pivot 30, the middle slide member 63 is disposed opposite to the heater member 61 and the slide member 62. In other words, the slide member 63 comprises a middle slide arm 73 journaled on the pivot 30, and a middle slide 74 which is fixed to the upper end of the middle slide arm 73 and to which a limit switch L is fixedly attached. The middle slide arm 73 is adapted to be swingable in association with the slide cam 26 via a cam roller 75. In this connection, between the lower ends of the arms 65,66 and 73 of the heater member 61, slide member 62 and middle slide member 63 and the supporting plate 11, spring members 76, 76 and 76 for biasing are interposed to cause the cam rollers 71,72 and 75 to be pressed against the heater cam 21, slide cam 24, and middle slide cam 26, respectively.

Next, the band feeding/tightening means F is described.

Figure 6:
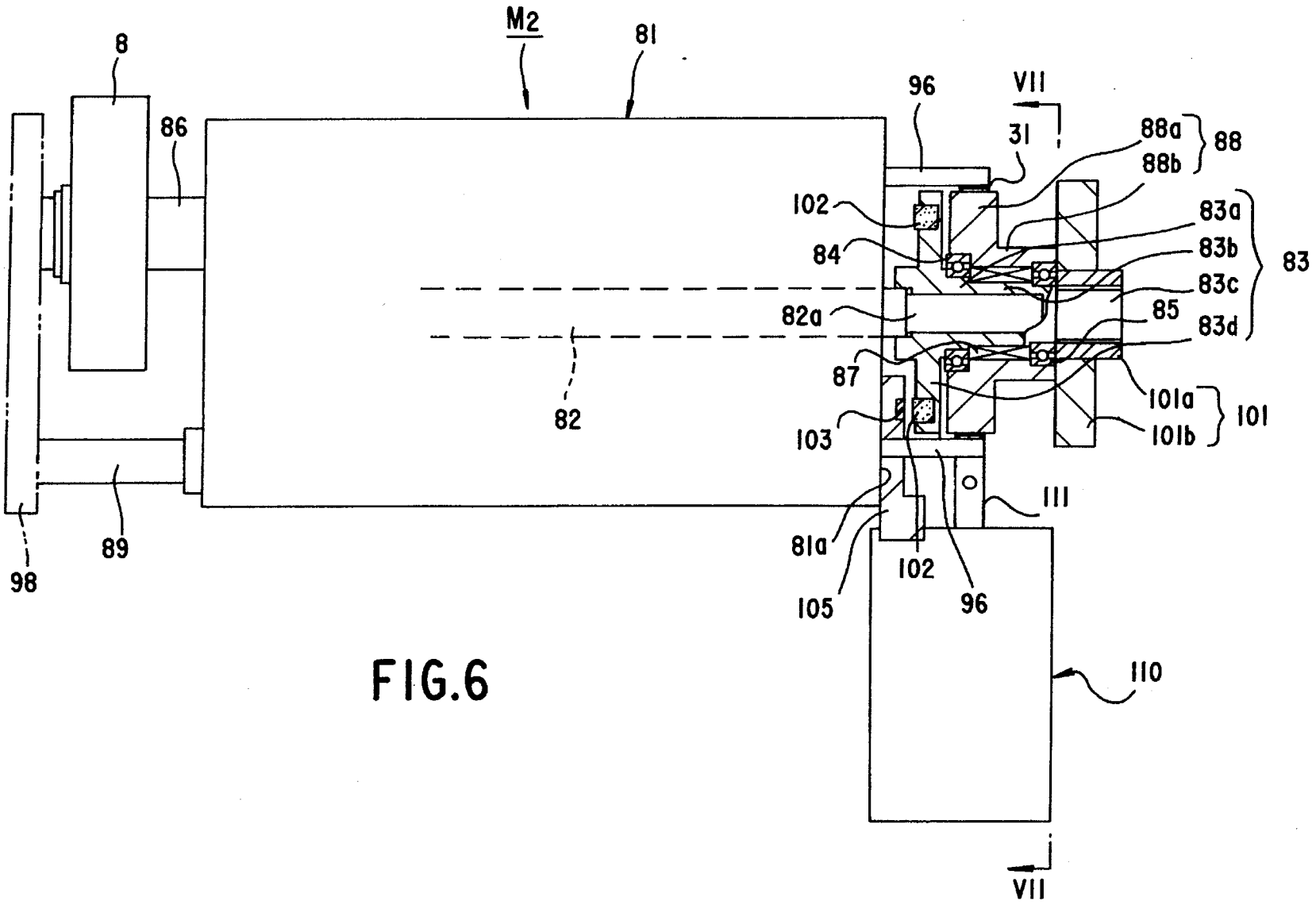
FIG. 6 is a vertical cross-sectional view of the feed/backfeed stepping motor M2 used in one embodiment of the strapping machine according to the present invention.
Figure 7:
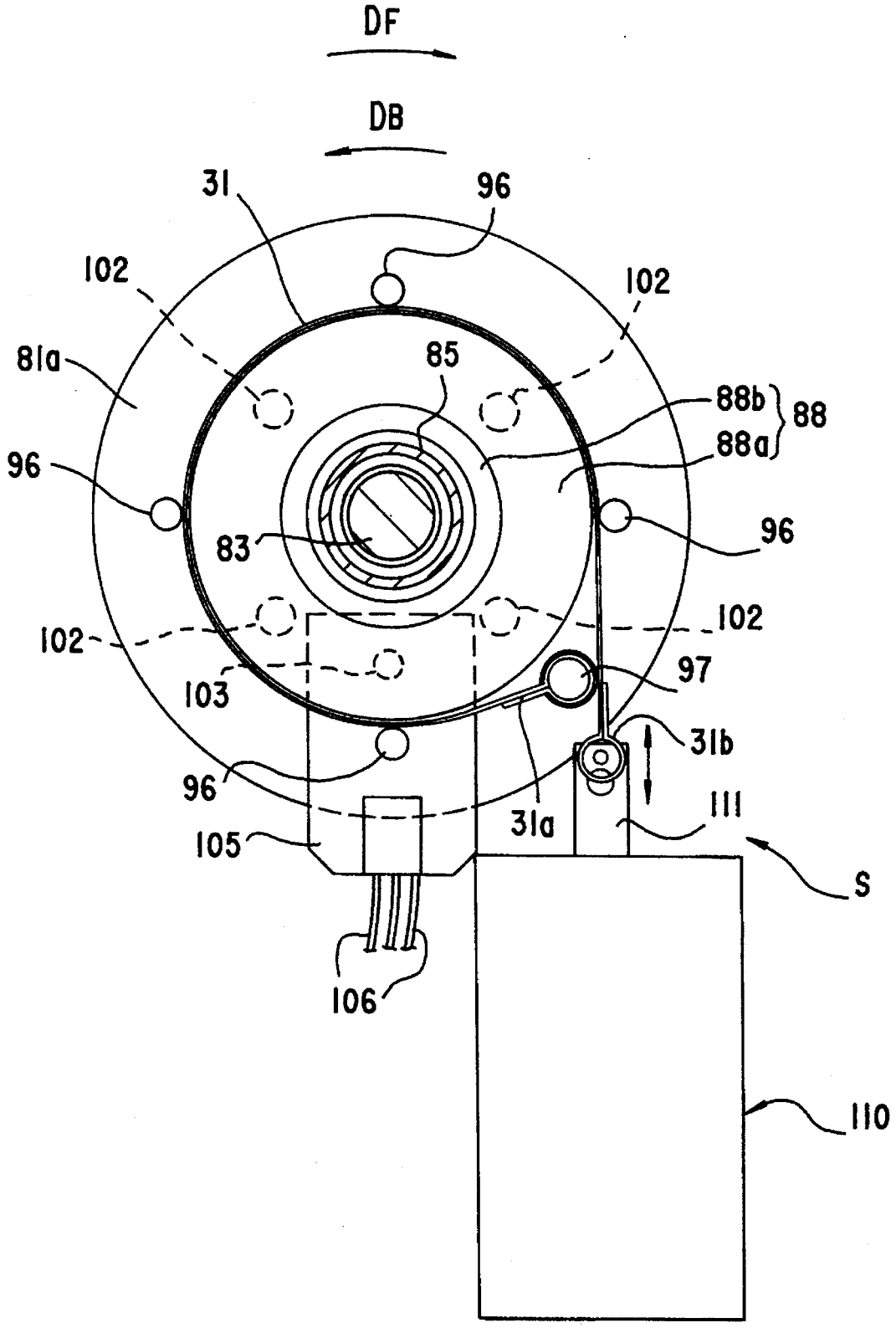
FIG. 7 is a view taken along the line VII—VII and viewed in the direction of the arrow in FIG. 6.

FIG. 6 is a vertical cross-sectional isolated view of the operative portion of the feed/backfeed stepping motor M2. FIG. 7 is a view of the same taken along the line VII—VII and viewed in the direction of the arrow in FIG. 6.

As the feed/backfeed stepping motor M2 according to the illustrated embodiment, a known stepping motor with a speed reducing mechanism is used. Specifically, a motor body 81 includes therein a stator having a polyphase winding wire, a rotor integrally formed with an output shaft 82 at its core portion, and a speed reducing mechanism for transmitting driving force from the output shaft 82 (none of the three are shown). A feed/backfeed roller shaft 86 connected to the speed reducing mechanism is so mounted as to protrude from the output side (the left side in FIG. 6) of the motor body 81. On the distal end portion of the feed/backfeed roller shaft 86 is fixedly mounted the above-mentioned feed/backfeed roller 8. In the vicinity of the periphery of the output side of the motor body 81, a mounting rod 89 for fixing a band guide cover 98 in front of the feed/backfeed roller 8 is so fitted to the motor body 81 as to protrude forward.

On the other hand, onto a rear cover 81*a* at the side (the right side in FIG. 6) opposite to the output side of the motor body 81, a planer hall element mounting member 105 with a hall element 103 fixedly attached to the outer surface thereof is mounted, and screw pins 96, 96, . . . are disposed and screwed so as to protrude along the circumference of the rear cover 81*a* for preventing a brake band 31, which will be described hereinbelow, from coming off. To the lower end of the hall element mounting member 105 are connected hall sensor lead wires 106 which transmit pulses generated upon passage of magnets 102, . . . , which will be described hereinbelow, over the hall element 103 to CPU (not shown) (see FIG. 7). Thus, the hall element 103, the magnets 102, . . . , the CPU and the like comprise a step-out sensor.

The above-mentioned output shaft 82 is so mounted as to extend from the side opposite to the output side, and composed of a stepped shaft having its tip formed with a diminished-diameter portion 82*a*. Around the output shaft 82 and its diminished-diameter portion 82*a*, a tubular multi-stepped sleeve 83 is externally fitted, and they are fixedly unified by means of a key or the like. In other words, the sleeve 83 is integrally formed of an enlarged-diameter portion 83*a* externally fitted and fixed onto the output shaft 82, and a medium-diameter portion 83*b* and a diminished-diameter portion 83*c* which backward extend from the enlarged-diameter portion 83*a* and stepwise diminished in diameter. The medium-diameter portion 83*b* is externally fitted and fixed onto the diminished-diameter portion 82*a* of the output shaft 82. Around the enlarged-diameter portion 83*a* is integrally formed a collar 83*d* having a circular profile, and in the outer surface of the collar 83*d* are embedded four magnets 102 with their surfaces partially exposed at such positions that the magnets 102 face to the hall element 103 in the course of rotation thereof. The sleeve 83 having such a structure is concurrently rotatable with the output shaft 82. Around a part of the enlarged-diameter portion 83*a* and the medium-diameter portion 83*b* of the sleeve 83 are mounted, as members of a reverse rotation preventive means, bearings 84, 85 and, via a one-way clutch 87, a stepped-tubular brake actuating member 88 composed of a tubular enlarged-diameter portion 88*a* and a tubular diminished-diameter portion 88*b*.

Further, around the diminished-diameter portion 83*c* of the sleeve 83 is fixedly mounted a damper 101 for preventing resonance which is composed of a hub 101*a* fixedly attached to the diminished-diameter portion 83*c* by spline-fitting or the like and a doughnut-like outer fitting 101*b* externally and unitedly fitted around the hub 101*a* and which is concurrently rotatable with the output shaft 82.

As shown in FIG. 7, around the enlarged-diameter portion 88*a* of the brake actuating member 88 is wound the above-mentioned brake band 31 which, in cooperation with the one-way clutch 87, is capable of timely locking rotation of the brake actuating member 88 in the feeding direction $D_F$ (clockwise direction in FIG. 7), and in turn, rotation of the feed/backfeed roller 8. The trailing end 31*a* of the brake band 31 is fastened to a screw pin 97 so mounted as to protrude from the rear cover 81*a*, and the leading end 31*b* is fastened to a tip portion of a movable iron core 111 of a plunger-type driving solenoid 110 mounted on the strapping machine body 10 at an appropriate position. In the driving solenoid 110, a stationary iron core on which a wire is coiled is mounted (neither shown). When the coiled wire is energized, the movable iron core 111 is caused to linearly move downward by the resulting magnetic attractive force to actuate the brake band 31, thereby enabling the rotation of the feed/backfeed roller 8 in the feeding direction Df to be locked according to need. The brake activating member 88, the brake band 31, and the solenoid 110 comprise a feed/brake mechanism S.

The rocker roller 9 is mounted in such a manner that it is normally caused to be pressed against the feed/backfeed roller 8 by means of a biasing means (not shown) (see FIG. 4).

As is seen from FIG. 4, the band B wound on the band reel 6 is led sequentially via a twist roller 92, an idle roller 93 and through the abutting portion between the feed/backfeed roller 8 and the rocker roller 9, a tubular band guide member 94, the guide aperture 44 of the front clamp 40, a gap between the press 55 and the middle slide 74, a gap between the rear clamp 56 and the slide table 67 and the like, and caused to emerge out of the top plate 4. Then, the band B is led making a loop around an object to be strapped (when a band arch is placed, the loop is formed in the course of passing the band B through the inner path of the band arch), and the leading end of the band B is reintroduced into the strapping machine 1 from a band introducing aperture 95 formed beside the slide table 67 and passed through a gap between the slide table 67 and the middle slide 74 and caused to touch the limit switch L, thereby completing setting.

Next, operation of the strapping machine 1 having such a structure according to one embodiment of the present invention will be described.

Figure 8:
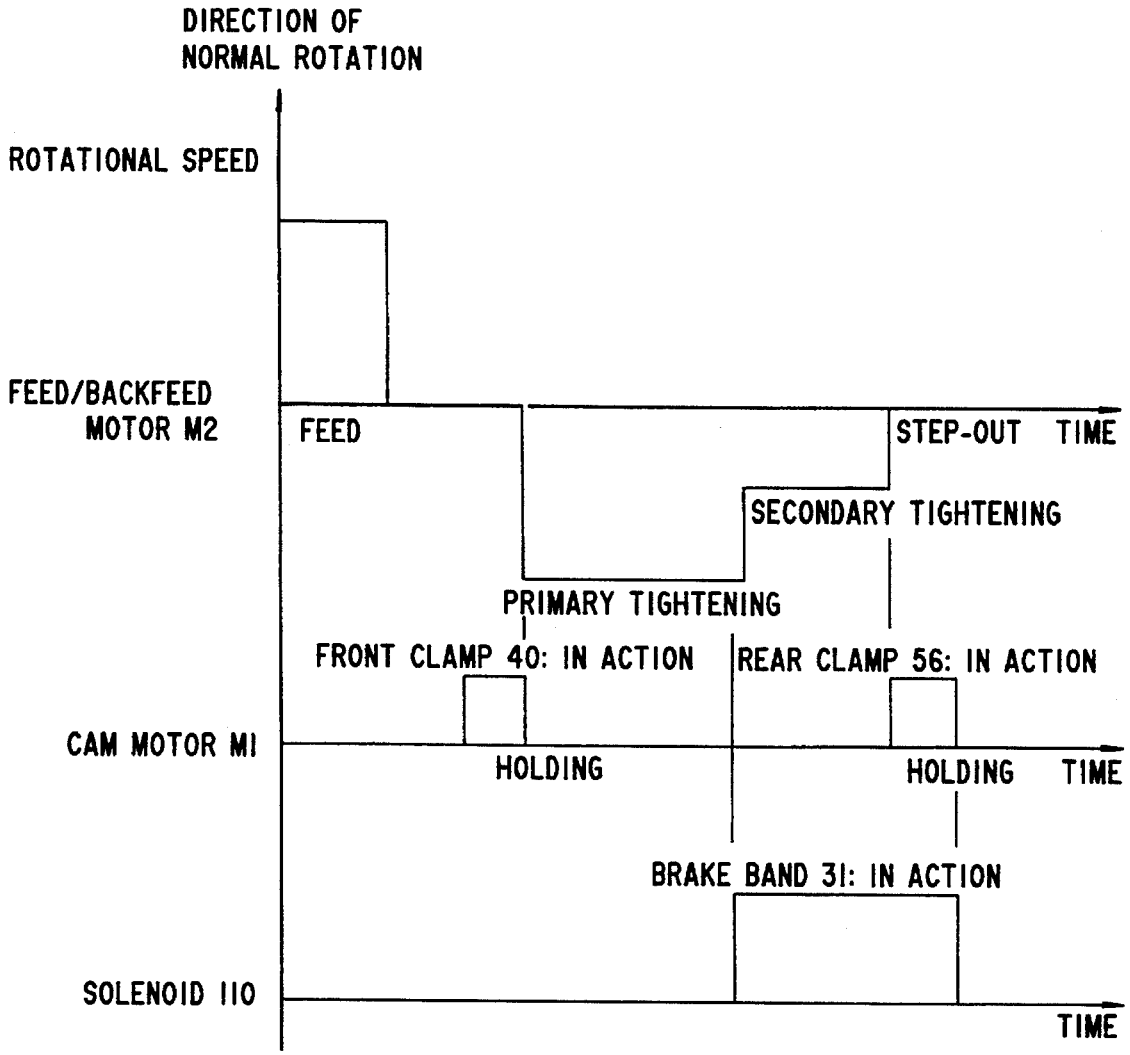
FIG. 8 is a time chart illustrative of operation of the strapping machine according to one embodiment of the present invention.

FIG. 8 is a time chart illustrative of operation of the strapping machine 1, in particular, it shows operations of the front clamp 40 and the rear clamp 56.

When a starting switch of a controlling device (not shown) is operated to actuate the stepping motor M2 for feeding/backfeeding, the feed/backfeed roller 8 starts in rotation to feed the band B. The band B is looped around an object to be strapped with a clearance therebetween, as described above, and caused to touch the limit switch L to stop the feed/backfeed stepping motor M2, thereby completing setting of the band B. During this band feeding period, the above-mentioned reverse rotation preventive means 87, S for preventing the rotation in the feeding direction $D_F$ is kept in an unactuated state, and the output shaft 82 rotates in the feeding direction Df at a predetermined rotational speed (see FIGS. 6 and 7).

Then, the cam driving stepping motor (cam motor) M1 is actuated to rotate the front clamp cam 22, and by the motion of the cam roller 52 which is a follower of the front clamp cam 22, the arm 43 is swung upward about the pivot 42 to boost the front clamp 40, so that the leading end of the band B thus fed is clamped between the upper end surface of the front clamp 40 and the lower surface of the slide table 67. Thereupon, the cam driving stepping motor M1 stops while the feed/backfeed stepping motor M2 starts in rotation in the direction of tightening (backfeed) $D_B$ reverse to the direction of feeding (feed) $D_F$ to carry out primary tightening under high-speed/low-torque operation. During a period from an appropriate time point after initiation of the primary tightening to completion of clamping by means of the rear clamp 56 after completion of secondary tightening, the brake band 31 is actuated to lock the brake actuating member 88, and hence the output shaft 82 is also locked by the reverse rotation preventive action of the one-way clutch 87 (see FIGS. 6 and 7).

When the primary tightening is started, the output shaft 82 starts to rotate, and attendantly thereupon, the collar 83*d* of the sleeve 83 and the magnets 102, . . . fixedly embedded in the collar 83*d* are rotated concurrently with the output shaft 82. Since the magnets 102 are disposed at phase differences of 90 degrees, one of the magnets 102 passes over the hall element 103 every quarter rotation of the output shaft 82, thereby generating pulses at intervals corresponding to the rotational speed of the output shaft 82. Accordingly, when the output shaft 82 is rotated at a rotational speed which is regarded as a step-out, for example, a rotational speed of 200 pulses/rotation, number of pulses of a motor driving pulse power generating means (not shown), which is counted in one interval between the pulses by means of the hall element 103 and which corresponds to the predetermined rotational speed of the output shaft 82, is 50 pulses/quarter rotation (hereinafter, this unit is omitted).

Figure 9:
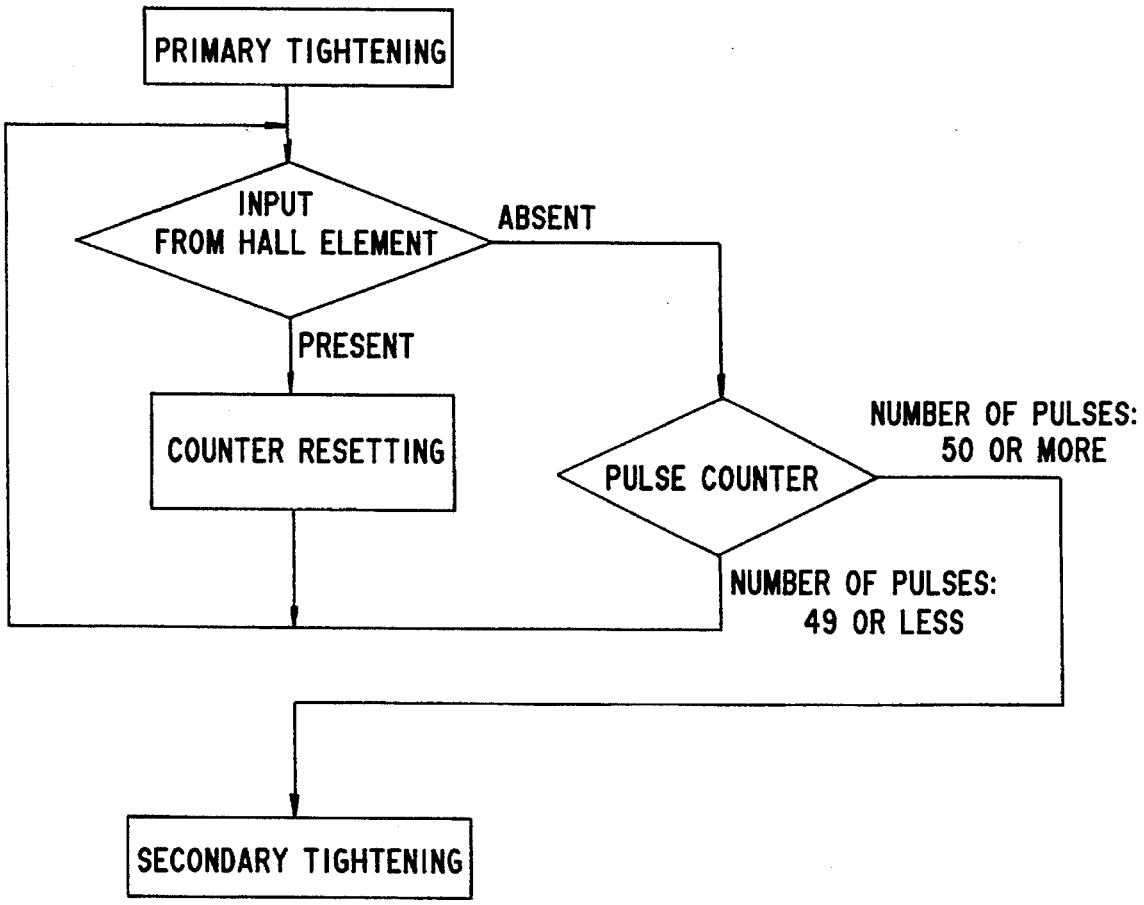
FIG. 9 is a flow chart illustrating operation of the step-out sensor used in the strapping machine according to one embodiment of the present invention.

FIG. 9 is a flow chart illustrating operation of the step-out sensor.

First, when a pulse from the hall element 103 generated by the rotation of the magnets 102, . . . is inputted, the CPU resets number of counted driving pulses of the pulse motor and begins to count anew. In this connection, since the magnets 102, . . . have a certain width, the counter resetting and the renewal of counting are repeated with driving pulses necessarily less than 50 inputted during a quarter rotation of the magnets 102, . . . Under this operational condition, when the band B is caused to abut upon the peripheral surface of the object under strapping to such an extent that a predetermined tension is exerted on the band B and the resulting torque in excess of a predetermined level is thereby exerted on the output shaft 82, number of counted pulses exceeds 50 and, accordingly, a step-out is regarded as having taken place, followed by automatic changeover to the subsequent operation (secondary tightening). In other words, operation mode of the feed/backfeed stepping motor M2 is automatically switched over to low-speed/high-torque rotation to conduct the secondary tightening. On the other hand, when number of counted pulses does not exceed 50, a step-out has not yet taken place and hence the above-mentioned operation is afresh repeated (the primary tightening is conducted.)

As described above and shown in FIG. 8, before initiation of the secondary tightening, the solenoid 110 is actuated to cause the movable iron core 111 to descend and thereby the brake band 31 is clampwise pressed against the enlarged-diameter portion 88*a* of the brake actuating member 88 to lock the brake actuating member 88. Since the one-way clutch 87 is interposed between the brake actuating member 88 and the output shaft 82, it is ensured that the band B looped around the object under strapping is mechanically prevented from loosening due to reverse rotation of the output shaft 82 together with the brake actuating member 88 in the feeding direction $D_F$ before completion of the secondary tightening and actuation of the rear clamp 56.

Next, when the tension exerted upon the band B by the secondary tightening reaches a preset upper limit (which is higher than that in the primary tightening), the resulting high torque is exerted on the output shaft 82. Consequently, the feed/backfeed stepping motor M2 loses synchronism with inputted pulses, i.e., it is brought to a so-called step-out to automatically stop. During the period of the stop, the stopped state is automatically held by the actions of the reverse rotation preventive means 87, S. On the other hand, after completion of the secondary tightening, the cam driving stepping motor M1 is actuated again, thereby bringing the rear clamp cam 25 into operation to boost the rear clamp 56. Consequently, the rear of the overlapping nodal portion of the band B is clamped between the upper surface of the rear clamp 56 and the lower surface of the slide table 67. During this period, the stopped state of the feed/backfeed stepping motor M2 is held also mechanically by the action of the brake band 31 before the actuation of the rear clamp 56, thereby enabling the band B looped around the object under strapping to be prevented from loosening.

Then, the heater arm 65 and the middle slide arm 73, which respectively support the heater plate 64 and the middle slide 74 that are located oppositely each other in the width direction of the band B, swing to-and-fro in association with each other about the pivot 30 via the cam rollers 71 and 75 which are respectively caused to operate in response to the rotational motions of the heater cam 21 and the middle slide cam 26. In other words, when the middle slide 74 is caused to slide in the direction retreatal from the position adjoining to the nodally overlapping portion of the band B (the right direction in FIG. 5), concurrently therewith, the heater plate 64 is also caused to slide (being preceded by the middle slide 74) in the same direction (the right direction in FIG. 5). In this manner, the heater plate 64 is inserted into the gap in the overlapping portion of the band B, in which the band B is vertically spaced each other under tension, in place of the middle slide 74. Thereupon, the press 55 is boosted by the operation of the press cam 23 and the cam roller 57 to sandwich-wise press the band B in the overlapping portion on the heater plate 64, thereby simultaneously effecting fusion of the facing surfaces of the band B. In this connection, the press 55 is first pressed lightly against the overlapping portion of the band B, and then once caused to descend. Thereupon, the heater plate 64 is caused to retreat from the overlapping portion of the band B (toward the left side in FIG. 5), and then the press 55 is boosted again to cut the band B with the cutter member 59 at a position proximate to the front cramp 40. The press 55 is now strongly pressed against the overlapping portion of the band B, and in this condition, the overlapped portion of the band B is cooled for a predetermined period of time (for example, 0.3 to 0.4 sec.). Thereafter, the press 55 is caused to descend. Incidentally, during the first pressing operation and the cooling, the cam driving stepping motor M1 is kept in a stopped state with the press 55 kept at the boosted position.

Finally, the slide table 67, which has been kept at substantially the same level as the upper surface of the top plate 4 throughout the above-mentioned procedure, is caused to swing about the pivot 30 in the retreatal direction (the left direction in FIG. 5) via the cam roller 72 which is a follower of the slide cam 24, the slide arm 66 and the like.

As described above, according to the strapping machine of the present invention, the secondary tightening is conducted under a torque predetermined depending upon types of an object to be strapped and/or a band B, and the feed/backfeed stepping motor M2 is mechanically held during the secondary tightening by means of the feed/brake mechanism S and the reverse rotation preventive means, and thereby, optimum and stable secondary tightening force is constantly attained irrespective of the type of the object to be strapped, and yet, coming off of the band B and damage to the object to be strapped are prevented. Further, reduced power consumption is realized as compared with the case where a stopped state is maintained by means of a motor.

Hereinbefore, one embodiment of the present invention has been described in detail. It is, however, to be understood that the present invention is by no means restricted to the above-described embodiment and that various changes and modifications may be made without departing form the scope of the invention defined in the appended claims. For example, although the stepping motor M1 is used as the cam driving motor in the illustrated embodiment, another type of motor such as an induction motor may of course be used.

Further, although the band type brake is used for the feed/brake mechanism S, it is possible to stop rotation of the brake actuating member 88 by means of, for example, a rod-like stopper member movable to-and-fro in the direction parallel with the output shaft 82 or the like member.

Moreover, the changeover of the operation mode from the primary tightening to the secondary tightening may be conducted by means of a tension sensor instead of the step-out sensor.

Furthermore, the regular phase deference between neighboring magnets of the magnets 102, 102, . . . arranged on the same circle around the output shaft 82 is, of course, not restricted to 90 degrees.

As understood from the above description, according to the present invention, a strapping machine is provided which is adapted to be capable of constantly attaining a stable secondary tightening force and thereby capable of preventing a band from coming off an object to be strapped, which is capable of realizing reduced power consumption cost, and which is capable of being constructed into a simple and inexpensive structure as a whole.

What is claimed is:

1. A strapping machine, comprising:

a feed/backfeed stepping motor (M2) as a source of driving force:

a feed/backfeed roller (8) which is forwardly rotatable in a feed direction and reversely rotatable in a backfeed direction by said feed/backfeed stepping motor (M2) for conducting feed/backfeed of a band (B) to be looped around a periphery of an object to be strapped;

a reverse rotation preventive means for timely locking rotation of said feed/backfeed roller (8) in the feed direction (Df) of the band (B) while always permitting rotation of said feed/backfeed roller (8) in the backfeed direction (Db) of the band (B); and wherein said reverse rotation preventive means includes a one-way clutch (87).

2. The strapping machine according to claim 1, wherein said reverse rotation preventive means further includes a brake band (31) wound around the output shaft (82) of said feed/backfeed stepping motor (M2), and a driving solenoid (110) for tightening up said brake band (31) so as to brake the rotation of said output shaft (82) in the feed direction.

3. The strapping machine according to claim 1, including means for actuating said one way clutch during a secondary tightening of the band and for maintaining said one way clutch unactivated during a portion of a primary tightening of the band.

4. A strapping machine, comprising:

a feed/backfeed stepping motor (M2) as a source of driving force;

a feed/backfeed roller (8) which is forwardly rotatable in a feed direction and reversely rotatable in a backfeed direction by said feed/backfeed stepping motor (M2) for conducting feed/backfeed of a band (B) to be looped around a periphery of an object to be strapped;

a reverse rotation preventive means for timely locking rotation of said feed/backfeed roller (8) in the feed direction (Df) of the band (B) while always permitting rotation of said feed/backfeed roller (8) in the backfeed direction (Db) of the band (B);

means for sensing when tension in the band exceeds a certain level for changing between a high-speed primary tightening of the band to a low-speed secondary tightening of the band, and means for activating said reverse rotation preventive means at a time after beginning the primary tightening to a time after completion of the secondary tightening.

5. The strapping machine according to claim 4, wherein said means for sensing includes a step-out sensor.

6. The strapping machine according to claim 4, wherein said reverse rotation preventive means includes a one way clutch.

* * * * *